United States Patent [19]

Whitehurst

[11] 4,305,791

[45] Dec. 15, 1981

[54] METHOD FOR THE MANUFACTURE OF CAPACITIVE ELECTRONIC DISCS

[75] Inventor: Marshal L. Whitehurst, Indianapolis, Ind.

[73] Assignee: RCA Corporation, New York, N.Y.

[21] Appl. No.: 184,522

[22] Filed: Sep. 5, 1980

[51] Int. Cl.[3] ..... C25D 1/10; C23F 9/00

[52] U.S. Cl. ..... 204/5; 148/6.2

[58] Field of Search ..... 204/5, 3, 4, 32 R, 38 R; 148/6.2; 252/174.25; 134/2

[56] References Cited

U.S. PATENT DOCUMENTS

| | | | |
|---|---|---|---|
| 2,530,842 | 11/1950 | Ruggieri | 204/5 |
| 2,748,035 | 5/1956 | Duncan | 134/2 |
| 3,293,148 | 12/1966 | Dell | 148/6.2 |
| 3,904,488 | 9/1975 | Nosker | 204/5 |
| 4,109,028 | 8/1978 | Owen | 148/6.2 |

*Primary Examiner*—T. M. Tufariello

*Attorney, Agent, or Firm*—Birgit E. Morris; Edward J. Sites

[57] ABSTRACT

A method for passivating the surface of a recorded metal substrate in which the substrate is immersed for 5–30 minutes in a 35° C.–85° C. aqueous bath containing from about 5 to 30 g/l of an alkaline cleaner and from about 2.5 to 20 g/l of sodium dichromate, potassium dichromate, sodium permanganate, potassium permanganate, or mixtures thereof.

11 Claims, No Drawings

METHOD FOR THE MANUFACTURE OF CAPACITIVE ELECTRONIC DISCS

This invention relates to an improved matrixing process for the manufacture of capacitive electronic discs and more particularly is concerned with the treatment of recorded substrates to improve the fidelity of replication.

BACKGROUND OF THE INVENTION

Capacitive electronic discs (CED) have been developed which can have a relatively large volume of information. The recorded information can be, for example, various types of computer programs, large volumes of data, the text of books, manuals, catalogs and the like and electronic signal information. An advantage of CED's is that the volume of information which can be stored on a given size disc is many times greater than that which can be stored on conventional storage media such as magnetic tape, magnetic disc, audio type record or the like. A still further advantage of CED's is that if a sufficient number of copies of a given CED are molded the cost per disc is substantially less, on a volume of information recorded basis, than conventional recorded media such as magnetic tapes.

Video discs, a specialized form of capacitive electronic discs and video disc players have been developed for use with television receivers of the type normally used in the home. In U.S. Pat. No. 3,842,194 issued on Oct. 15, 1974 to Jon K. Clemens entitled "INFORMATION RECORDS AND RECORDING/-PLAYBACK SYSTEMS THEREFOR" there is disclosed a video disc system which employs a video disc made of an electrically conductive material which is played with a video disc player having an electrically conductive pickup stylus. When the video disc is played, the stylus rides in a groove on the surface of the video disc and a capacitance is established between the stylus and the disc. The capacitance varies according to the geometric variations in the depths of the recorded signal in the bottom of the groove. The generated signal of varying capacitance is converted by electronic means into a plurality of electronic signals required to reproduce the recorded television program.

Capacitive electronic discs, such as video discs of the type disclosed by Clemens, can have an overall physical appearance similar to a conventional long-playing audio record. The CED is however, substantially different in kind from conventional audio records particularly with regard to the relative size of the recorded signal elements and the relative density of the recorded information. CED's have information molded into the disc in a geometrical configuration which in comparison to conventional audio records is at least on the order of a magnitude smaller. Conventional audio records are typically designed to operate at frequencies of about 10,000 hertz while being played at about 33⅓ revolutions per minute (rmp). In comparison, CED's such as a video disc are designed to operate at frequencies of about 900 megahertz while being played at about 450 rpm's or even higher. The signal elements of a conventional audio record have a wavelength of about 6 microns. The signal elements of a CED have a wavelength on the order of 500 to 1,000 angstroms. The grooves on a conventional audio record are typically 50 to 60 microns wide with typically, substantially less than 200 grooves per centimeter. The groove width of a CED is only about 2.7 microns, and there are approximately 4,000 grooves per centimeter.

In the manufacturing process employed for the production of the CED's, most of the problems normally encountered in the manufacture of conventional audio records are encountered except that the problems are generally exaggerated because of the reduction in the size of the recorded elements.

The first step in the manufacture of records is to cut the initial recording into a substrate which then can be replicated to provide masters, molds, and finally the stampers which are used in the molding of the records. In the conventional prior art methods for the manufacture of audio records the information is recorded into a wax or, more preferably, a lacquer substrate. The recorded wax or lacquer substrate is then coated with silver or nickel. After a sufficient amount of the metal has built up, the recorded substrate is separated from the metal replica. Because of the relatively large size of the signal elements, the low density of the recorded information and the differences between the materials of the substrate and master, no substantial problems are encountered in separating the recorded lacquer or wax substrate from the electroplated metal master in the manufacture of audio records.

It has been found that the CED's cannot be satisfactorily recorded using wax or lacquer substrates, as the required minute details in the recorded grooves of CED's cannot be accurately cut and maintained in wax or lacquer substrates. The recording for a CED has to be made in an extremely hard fine grained substrate. The preferred substrate for the manufacture of a CED is an electro-deposited layer of fine grained bright copper.

After recording, the copper substrate is electroplated in the matrixing process to produce masters from which molds and then stampers are produced. It is extremely important to protect the recorded surface of the copper substrate from damage during the matrixing process, as any damage causes an undesired signal called noise which is repeated in each generation in the matrixing process and ultimately in the final molded CED's.

The most critical step in the matrixing process of CED's occurs when the copper substrate is electroplated with nickel to form a master. The electro-deposited nickel on the copper substrate must conform to the recorded surface of the copper substrate but, after the copper substrate has been electroplated with a sufficient amount of nickel to provide a self-supporting master, the resulting nickel master must cleanly separate from the copper substrate. If any of the nickel remains on the copper substrate or if any of the copper transfers to the nickel master, there is a deterioration of the desired signal and a corresponding increase in noise in the final CED.

To facilitate the separation of the electroplated nickel master from the copper substrate the surface of the substrate is passivated prior to electroplating. Passivation provides a protective coating layer on the recorded substrate which assists in the separation of the electroplated layer, that is, the master from the copper substrate.

Various methods have been suggested in the prior art for passivating metal surfaces such as for example nickel or noble metal surfaces. The most commonly employed method for passivating metal surfaces in the prior art is to initially wash the metal surface with an organic solvent, then with an alkaline cleaner mixture, then with a strong acid, and finally with a strong oxidizing agent.

The above method of passifying metal surfaces is widely used in the audio record industry. Ruggieri, U.S. Pat. No. 2,530,842 for example, discloses cutting the desired recording into a lacquer or wax substrate. The recorded lacquer or wax substrate, which does not require passivation, is then plated with a metal such as gold or silver to provide a master of the recorded substrate. The master is separated from the lacquer or wax cutting and the surface of the master is passivated as noted above, that is, by treating it with an alkaline cleaner, then with a strong acid solution, and then with a strong oxidizing solution.

The prior art three-step passivation procedure, that is, the alkaline treatment, acid treatment, and oxidizing treatment, while satisfactory for audio records, is unsuitable for passivating recorded copper substrates of the type employed in the manufacture of CED's. The multi-step passivation treatment appears to result in considerable damage to the surface of the recorded copper substrate. The damage to the recorded copper substrate is reflected as an undesirable increase in noise and causes reduction in the number of masters which can be satisfactorily formed from the recorded substrate.

It would be highly advantageous if a method could be provided for passivating the recorded copper substrates which would not adversely affect the signal-to-noise ratio and would permit an increased number of replicas to be made from a recorded substrate.

SUMMARY OF THE INVENTION

In accordance with this invention, metal substrates, especially recorded copper substrates which are to be electroplated in the matrixing process for the manufacture of capacitive electronic discs, are passivated by immersing the metal substrate into an aqueous mixture containing a mild alkaline cleaner and a strong oxidizing agent. A protective coating is formed on the surface of the metal which is thinner than that obtained with the prior art process but provides a greater protection.

DETAILED DESCRIPTION

In describing the present invention specific attention will be directed to the passivation of recorded copper substrates as this is the specific application wherein the present invention has been found to be especially useful. It should be noted, however, that the present invention is not limited to the passivation of copper substrates and that other metals such as nickel and silver can also advantageously be passivated in accordance with the method of this invention.

The surface of the recorded copper substrate prior to passivation is solvent washed to remove organic soluble oils and additives from the surface of the substrate. This is best done by washing the recorded substrate with a series of organic solvents. A solvent wash procedure which has been found to be especially useful, particularly with recorded copper substrates, is to initially wash the recorded substrate with tetrahydrofuran, then with acetone, and then with isopropyl alcohol after which the substrate is dried with an inert gas such as dry nitrogen.

The recorded substrate is now ready for passivation. The passivation is conducted in an aqueous bath which contains an alkaline cleaner and an oxidizing agent.

The alkaline cleaners which have been found to be suitable contain principally trisodium phosphate and/or tetrasodium pyrophosphate. In addition, the alkaline cleaning mixture should generally contain some other additives such as wetting agents and chelating agents. There are a number of suitable commercial products which can be used as the alkaline cleaner. One such commercial product which has been found to be satisfactory is known as NS-35 and is sold by Enthone, Inc. The amount of the alkaline cleaner in the passivation bath is somewhat dependent on the composition of alkaline cleaner employed but should be sufficient to remove alkaline soluble or dispersible soils and other similar contaminants from the surface of the recorded substrate. The amount which must be added for the purposes of this invention is not critical, with amounts between 5 and 30 grams per liter (g/l) being adequate for most purposes.

The oxidizing agent added to the passivation bath of this invention can be, for example, potassium or sodium dichromate or potassium or sodium permanganate or mixtures of these materials with the preferred material being potassium dichromate.

The amount of the oxidizing agent in the bath has a significant effect on the quality of the passivation coating formed on the substrate particularly at the lower end of the concentration range. When the concentration of the oxidizing agent is below 2.5 g/l, the passivation coating will have a significant number of pinholes through the coating which can adversely effect the coating. If the concentration is above about 5 g/l, there is a dramatic decrease in the number and size of pinholes in the coating. Increasing the concentration of the oxidizing agent up to about 20 g/l does not significantly change the quality or the thickness of the passivation coating but is advantageous in that it provides a reserve of oxidizing agent in the bath. If the concentration of the oxidizng agent in the bath is maintained between 2.5 g/l and 20 g/l, satisfactory results are obtained with the optimum results from the amount of material employed being obtained when the concentration of the oxidizing agent in the bath is maintained at about 5 g/l.

The time of immersion of the substrate in the passivating bath has a definite effect on the quality and the thickness of the passivation coating. The formation of the passivation layer is a function of the time of immersion until a given thickness of film is formed on the substrate. Immersion times of less than about 5 minutes give relatively poor coatings. Between 5 and 10 minutes the quality of the coating with regard to being pinhole free and having good release properties improve substantially, with the optimum results being obtained at about 10 minutes. Immersion times in excess of 10 minutes are not harmful but there is no advantage to longer times in that the coating appears to reach a maximum thickness and no further thickness of the coating develops with longer times of immersion.

The temperature of the passivation bath does have a direct influence on the quality of the passivation layer. The passivation bath should advantageously be maintained at a temperature between 35° and 85° C., as in this temperature range satisfactory coatings are consistently obtained. Increasing the temperature of the bath causes the thickness of the coating to increase. The film of the passivated coating formed on the substrate at about 55° C. is almost 60% thicker than one formed at 35° C. The relative increase in film thickness, however, lessens somewhat as the temperature is increased above 55° C. For example, increasing the temperature from 55° C. to 75° C. causes only about a 5% increase in the thickness. At about 55° C. there is a leveling off of the improvement with regard to the reduction in the amount of pinholes and the thickness of the coating is at about its maximum. For purposes of obtaining both a quality coating with a minimum number of processing problems it has been found that the best results are obtained if the temperature of the bath is maintained in the range of about 55° to 65° C.

The particular process parameter employed for the passivation is likewise dependent upon the substrate which is to be passified. It has been found, for example, that when a copper substrate is passified, the optimum oxidizing agent is potassium dichromate. The passivation of copper substrates is conducted by initially solvent stripping the copper substrate. The copper substrate is then immersed into an aqueous solution preferably containing about 30 g/l of an alkaline cleaner and 5 g/l of the potassium dichromate at a temperature of about 65° C. for about 10 minutes. During treatment the passivating bath is agitated about the copper substrate. Using this process for copper substrates it has been found that the resulting substrate has superior properties, especially as compared to the passivated substrates treated in accordance with the method of the prior art.

There are several distinguishing features of the present invention as compared to the conventional passivation methods. In the present invention there is no need for the separate treatment of the substrate with a strong acid such as sulfamic or sulfuric acid. The elimination of the strong acid treatment is a significant improvement in that it both simplifies the treatment process and, even more important, it eliminates the tendency of the strong acid treatment to somewhat attack the substrate and impart undesirable noise to the desired signal. A further distinguishing feature is that the alkaline cleaner and the strong oxidizing agent are in the same bath. This further simplifies the passivation process and also appears to significantly increase the quality of the passivation layer with regard to protecting the underlying substrate. While there is no intention to rely on theory of reaction for patentability, it is believed that the presence of both the alkaline cleaner and the strong oxidizing agent in the same bath results in a more uniform treatment as a result of the freshly cleaned surface provided by the alkaline cleaner being presented immediately for oxidation by the oxidizing agent.

In any event it has been found that the passivation coating of the present invention is thinner than the prior art coating, which is of an advantage in maintaining a high signal-to-noise ratio. In addition, quite suprisingly even though the passivation layer of the present layer is thinner, it is more protective and does not have the number of pinholes of the coatings of the prior art processes.

The following example is given by way of further illustration of the invention but is not intended to limit in any way the scope of the present invention beyond that of the subjoined claims.

EXAMPLE 1

A comparison was made between copper substrates passivated in accordance with the procedures of the prior art and that of the present invention. A disc of aluminum was electroplated with copper. The copper plated disc was then divided into a number of parts.

In accordance with the prior art teachings, a control part was solvent stripped, dried, and then rinsed with water. This sample was then immersed into a 30 g/l solution of an alkaline cleaner (NS-35) at 65° C. for 10 minutes and rinsed with water. The sample was then immersed in a 2% by weight solution of sulfamic acid for 1 minute at 22° C. and rinsed with water. Finally the sample was immersed in an aqueous 5 g/l solution of potassium dichromate, $K_2Cr_2O_7$, at 22° C. for 3 minutes, rinsed and dried. The surface of the copper sample was analyzed by Auger analysis at the beginning of the treatment and after each of the three separate steps to determine the thickness and type of coating formed on the surface as a result of the three separate treatments.

A second sample of the copper coated substrate was treated in accordance with the method of the present invention. The sample was solvent washed and dried and then rinsed with water. The sample was then immersed into an aqueous solution of 30 g/l of alkaline cleaner NS-35 and 5 g/l of potassium dichromate at 65° C. for 10 minutes. The treated sample was then rinsed with water and dried. The film on the surface of this sample was also evaluated by Auger analysis for the thickness and chemical composition of the coating. The results of the above evaluations are listed in the chart below:

| | Cu | Cr | O | C | S | Film Thickness, Ang. |
|---|---|---|---|---|---|---|
| Copper substrate surface at start (no treatment) | 40 | -0- | 10 | 47 | 3 | 4 |
| Control three-step process: | | | | | | |
| 1. after alkaline cleaner | 57 | -0- | 22 | 19 | 3 | 40 |
| 2. after sulfamic acid | 59 | -0- | 22 | 18 | 2 | 37 |
| 3. after potassium dichromate | 32 | 13 | 36 | 18 | 1.1 | 25 |
| Present Invention: | | | | | | |
| 1. after one-step treatment in alkaline cleaner and potassium dichromate | 49 | 5 | 29 | 17 | 0.6 | 15 |

The carbon content noted in the surface of the films in the chart above is believed to be due to residual amounts of the organic based brightener used in the deposition of the copper during electroplating.

The passivation film of the present invention as shown above is about 70% thinner and the chromium enrichment of the surface is significantly lower than that of the prior art treatments. Despite the difference in thickness the coating of the present invention has superior properties with regard to protection of the underlying substrate.

After passivation the relative amount of pinholes in the sample treated, according to the teachings of the prior art and that of the present invention, were determined by contacting the surfaces of each sample with a dilute solution of silver nitrate for 30 seconds. The pinholes in the coating were evidenced by the formation of dark spots on the substrate. The examination of the substrates after treatment with the silver nitrate clearly showed that the samples passivated in accordance with the present invention had substantially fewer pinholes and further, the holes that were present were significantly smaller than those in the sample treated according to the prior art method.

What is claimed is:

1. The method for the passivation of the surface of a recording substrate comprised of a metal selected from the group consisting of copper, nickel or silver which comprises immersing said substrate into an aqueous mixture containing from about 5 to 30 g/l of a mild alkaline cleaner consisting essentially of trisodium phosphate, tetrasodium pyrophosphate or mixtures thereof and from about 2.5 to 20 g/l of an oxidizing agent selected from a group consisting of sodium dichromate, potassium dichromate, sodium permanganate, potassium permanganate, and mixtures thereof, said aqueous mixture being maintained at a temperature between 35° C. and 85° C. and the time of immersion being maintained between 5 and 30 minutes.

2. The method according to claim 1 wherein the oxidizing agent is potassium dichromate.

3. The method according to claim 1 wherein the aqueous mixture contains about 5 g/l of potassium dichromate.

4. The method according to claim 1 wherein the aqueous mixture contains about 30 g/l of alkaline cleaner and about 5 g/l of potassium dichromate and the mixture is maintained at a temperature of about 65° C. and the time of immersion is about 10 minutes.

5. The method according to claim 1 wherein the metal substrate is initially washed with an organic solvent which removes the organic soluble impurities on the substrate prior to immersion in the aqueous mixture.

6. A metal substrate having the surface therefore passivated in accordance with the method of claim 1.

7. In the method for the manufacture of record stampers for use in the molding of capacitive electronic discs wherein a copper substrate is recorded with the information desired to be molded into the disc and is thereafter electroplated to provide a replica to be used as a master for the manufacture of the stampers, the improvement which comprises passivating the surface of the recorded copper substrate by immersing the substrate into an aqueous bath containing 5 to 30 g/l of a mild alkaline cleaner consisting essentially of trisodium phosphate, tetrasodium pyrophosphate or mixtures thereof and 2.5 to 20 g/l of an oxidizing agent selected from the group consisting of sodium dichromate, potassium dichromate, sodium permanganate, potassium permanganate, and mixtures thereof, said aqueous bath being maintained during time of immersion at a temperature between 35° C. and 85° C. and said time of immersion being maintained between 5 and 30 minutes.

8. The method according to claim 7 wherein the oxidizing agent is potassium dichromate.

9. The method according to claim 7 wherein the aqueous bath contains about 5 g/l of potassium dichromate.

10. The method according to claim 7 wherein the aqueous bath contains about 30 g/l of the alkaline cleaner and about 5 g/l of potassium dichromate and the bath is maintained at about 65° C. with the time of immersion being maintained at about 10 minutes.

11. The recorded copper substrate passivated in accordance with claim 7.

* * * * *